US005823215A

United States Patent [19]

Chou et al.

[11] Patent Number: 5,823,215

[45] Date of Patent: Oct. 20, 1998

[54] AUTOMATIC CLOSING AND OPENING UMBRELLA WITH FIXED TYPE OF PLURAL SECTIONS OF MIDDLE ROD IN VARIABLE DYNAMIC PROCESS AND RATIO

[76] Inventors: Lung-Chiao Chou, No. 1, Alley 9, Lane250 Sec 2, Cheng Gung Rd., Nei Hu Area, Taipei, Taiwan; Chin-I Lin, No. 23, Jui Yuan Area, Ta Hsi City, Taoyuan Hsien, Taiwan

[21] Appl. No.: 651,956

[22] Filed: May 21, 1996

[30] Foreign Application Priority Data

Feb. 8, 1996 [CN] China ..... 96 2 29266.4

[51] Int. Cl.[6] ..... A45B 25/14

[52] U.S. Cl. ..... 135/24; 135/22; 135/25.1

[58] Field of Search ..... 135/22, 24, 25.1, 135/20.3, 25.3, 25.33, 28

[56] References Cited

U.S. PATENT DOCUMENTS

| | | | |
|---|---|---|---|
| 4,941,494 | 7/1990 | Wu | 135/24 X |
| 4,989,625 | 2/1991 | Wu | 135/22 |
| 5,178,174 | 1/1993 | Wu | 135/24 X |
| 5,224,505 | 7/1993 | Wu | 135/25.33 X |
| 5,309,932 | 5/1994 | Chou et al. | 135/22 |
| 5,390,686 | 2/1995 | Lin et al. | 135/24 |
| 5,441,065 | 8/1995 | Lin et al. | 135/20.3 X |
| 5,505,222 | 4/1996 | Lin et al. | 135/24 |
| 5,626,160 | 5/1997 | Ko | 135/24 X |
| 5,626,161 | 5/1997 | Lin et al. | 135/24 |

*Primary Examiner*—Lanna Mai
*Attorney, Agent, or Firm*—Bacon & Thomas

[57] ABSTRACT

This invention is an umbrella in automatic opening and closing manner with its rod in the middle, which has multiple sections, and it is in variable dynamic process including the umbrella's skeleton mechanism, spring, locating device, shuttle arrow, control mechanism, handle, change-over device and pulling rig. Its main novelty is that within the middle rod of the umbrella's skeleton, a contrivance to change is installed. At the ends of the pulling rope in the contrivance to make changes, they respectively reach the lower nest and shuttle arrow. The control mechanism is manipulated by the pressing of of the button to release the umbrella's skeleton in particular position for closing and folding and the reserve energy of the spring. In coordination with both pulling ropes, each section of skeleton is tracted to extend and make the upward movement of the lower next to open the umbrella. The locating device fastens the middle rod at the fixed position to resist against wind. It can release the traction force between sections of the skeleton under the firm control of of shuttle arrow. The spring between branch skeletons in the umbrella is to close the umbrella and to change the place to return to the original point.

5 Claims, 5 Drawing Sheets

AUTOMATIC CLOSING AND OPENING UMBRELLA WITH FIXED TYPE OF PLURAL SECTIONS OF MIDDLE ROD IN VARIABLE DYNAMIC PROCESS AND RATIO

BACKGROUND OF THE INVENTION

The present, the multiple folding type of umbrella in automatic manner which is on sale in the market or which is made under patent has been designed to have multiple sections of skeleton rod on the middle rod of the umbrella's skeleton which are mutually encased in telescopic way. In other words, its extension and opening completely depend upon the energy reserving spring to open umbrella that is provided on the full length of middle rod. That assembled spring is required to pass through each section of skeleton rod for its completion. Thus when each section of skeleton rod on the middle rod extends and developes it opening shape, there is no way to install the locator for the fixation of position so that it cause the prevention of each section of skeleton rod and the middle rod from contractions, because its umbrella's surface enlarges to receive more wind as its area increases. The traditional style of umbrella may sustain significant wind force. Or when its user holds it by hand in his upward or down ward motion, the middle rod would be unable to withstand the wind or the user's swaying act to make the local contractions of the middle rod and the area of the opening umbrella's surface area umbrella's surface area slightly closes in not completely opening state. Then when the wind diminishes or eliminates, the spring resumes its function to make completely opening state of the umbrella. That defect causes the user to feel puzzled and inconvenient in use.

There is another design for plural sections of umbrella's middle rod for its automatic losing and opening. It utilizes the pulling rope assembled within the middle rod. It acts in conjunction with the installation of pulley on the upper nest for twining, assembly and installation to make both ends of the pulling rope respectively located at the inside and outside positions. The both ends do respectively connect the lower nest and fastener head which is opposite the fastener sheet within the handle being the automatic buttoning function. The pulling rope straddles over the pulley which can slide and move as the traction of lower nest in upward direction. The sections of skeleton rod are encased each other in telescopic manner as we know. Within the middle rod, each section of skeleton rod is penetrated and installed with springs for opening umbrella, which have the function to open it by extending the middle rod. Therefore, the said middle rod can not takes the stand firmly at any given position to prevent the vibration or withstand the wind force, thus the umbrella's surface being unstable which is a defect that can not be overcome or improved. Although in its structure, it discloses the theory of pulling rope and through the use of pulling rope, the lower nest is pulled to make its opening act, but the pulling rope is connected to the lower nest and fastener head, which can not produce the act in ratio, adjustment and variation correspondingly and in structure. The sections on the middle rod cause some restriction and so the traditional one can only apply to the umbrella with the middle rod of three sections. It is due to the fact that there is the matching problem of the contraction of the length of the plural sections of the middle rod after its being contracted with the pulling rope when the middle rod is in extension state and hence there is no way to apply such function to the umbrella with the four sections. When the number of sections on the middle rod becomes more, relatively the length of each section of skeleton rod shortens but the length of the middle rod when the umbrella opens and extends, remains the same (No matter how many sections in the middle rod, the lengths of extended and opened umbrella are almost same.) At that time, the length of that pulling rope needs to correspond to the length of of the middle rod when the umbrella opens and fasten the fastener head freely to extend to the lower nest. So when the length of single section of skeleton rod shown when the middle rod contracts and the umbrella surface closes shall be smaller than the length of the pulling rope so that the pulling rope clusters within the middle rod or some of the rope gathers between the outside of the middle rod and lower nest. Under the condition that the pulling rope assembles at the inside of the middle rod, which may cause the pulling rope and spring lines to twist each other and then the user can not open the umbrella later or he can not make full opening of it that is defect to affect the functioning of it. Although the fastener head mentioned previously made in pulling rope for the control of lower nest for checking and releasing and closing umbrella, that fastener head is directly connected with the lower nest, which can only control the act of lower nest but it can not be organized in the present case to produce the contraction, motion and the release and control by shuttle arrow simultaneously. Besides, the previous case needs to equip the fastening sheet in horizontal and flexible manner within the handle for the fastener head's checking and releasing in coordination with the pressing button to make direct flexible acting fastener with the present invention's structure and manipulation.

SUMMARY OF IHE INVENTION

In consideration of the traditional defects, the present practical new type of device aims mainly at providing the dynamic process in ratio of the pulling rope which can be adjusted and changed within the middle rod of umbrella skeleton corresponding to the number of sections of skeleton rod to be assembled and installed to fit for the acts in ratio and then it is in coordination dynamic energy volumes needed in the dynamic process in opening umbrella for proportional variation thus established for the control of the mechanism and operation by buttoning to show dynamic force and dynamic action in proportional variation so as to extend the middle rod in opening the umbrella with the coordination of the locator to withstand wind. All of such new devices are used to overcome the defects indicated in the traditional plural sections of rod in umbrella.

In order to attain the above aim, this practical invention realize the purpose mentioned above.

The present invention is fixation of position type of umbrella with plural sections of middle rod to make variations of dynamic force and action, which is composed of the umbrella's skeleton mechanism, spring, locator, shuttle arrow control device, handle and the variable mechanism.

The mechanism of the skeleton with plural sections is made up of middle rod and various components, spring for closing umbrella, and its branch skeleton. There is an upper nest provided with a hole on the side wall of the upper nest. Under the hole, there provides a formed portion for rope placement to serve as the first pulling rope for twining variable mechanism, which extends to the end outside of the middle rod to be connected to the lower nest of the action tube of locator provided on the lower nest of the middle rod to draw and pull the movement of lower nest. At same time, there is a fastening hole provided on the upper section of the skeleton rod which correspond after the middle rod extends and the upper nest moves so that the locator can affix itself at the definite position.

The spring for opening umbrella is provided within the middle rod with its one end corresponding to locator's edge at the upper end of the long hollow seat of the variable mechanism. The locator's edge supports against the position of the lower end face of the upper nest. Its other end corresponds to protruding point formed at the lower section skeleton rod fabricated in check.

Locator is installed at lower nest, which includes a fastening sheet installed in the containing chamber provided at the lower nest. At same time, there installs an action tube of sliding hook encased between the lower nest and the middle rod. That action tube corresponds to be drawn by the first pulling rope. There equips a spring in the space between the projecting shoulder wall and the inside of the upper nest in check. The action tube is drawn by the first pulling rope to move upward for reserving energy and to to push the lower nest to move upward to open umbrella. The fastening sheet attaches the upper section of skeleton rod at definite point to withstand wind. The action tube and spring releases its energy to move downward the upper end of the sliding hood's edge in order to set loose the fixation by the fastening sheet of the upper section skeleton rod.

The variable mechanism has a long hollow tube which in coordination with the locator's edge of the upper end, corresponds to one end of spring to open umbrella placed within the middle rod to make direct check against the bottom end of the upper nest for position to be fixed. Within the hollow long seat, there provides a fixed rope seat to be used for moving the movable rope seat. That movable rope seat is in closing and folding state which is positioned near the bottom end face at the upper end of long seat. Further at the seat body of the movable rope seat there provides a formed portion for rope placement for making the second pulling rope. The second pulling rope's end extends and connects the fixed rope seat at the lower lower end of the long hollow seat along the space of the inner side of the long hollow seat while the other end of the second pulling rope extends from within the long seat and penetrates the fixed rope seat's socket hole to be connected with the upper end of the shuttle arrow to from the dynamic process in ratio of the length. It is motion variable ratio corresponding to the extention of the middle rod.

The shuttle arrow provided on the lower section skeleton rod with one end corresponding to one end of the second pulling rope and with the other end extending toward the handle to form a fastening block which may correspond to the holding and control of the control mechanism for the action to manipulate the closing of umbrella.

The control mechanism includes the hollow tube seat at the inner side within the lower section of the skeleton rod. The upper end of the tube seat and its side face are respectively provided with passage hole and fastening hole for the fastening block of the the shuttle arrow to insert into the hole in coordination with the function of the second recoiling sheet to support and hold it in the fastening hole at definite position. At same time, within the tube seat, there is a fastening sheet to serve as the function of the first recoiling sheet press against the middle rod rod in response to he buttoning operation of the handle for holding or releasing. The first and second recoiling sheets show different lengths and they are superimposed at the rear side of the fastening sheet.

The handle is assembled in fixation style at the end of the lower section of skeleton rod, including a hollow inner set seat. The side end wall of the inner set seat has a set of button holes. At the button holes upper and lower side's end edge, there are two positions opposite to each other which respectively form a sustaining seat each to span a recoiling sheet in bridge type which is provided between the inner side face of the button and the flexible pressing board to serve the act to return and to correct the flexible pressing board to become horizontally normal. The inner side end wall of the button is provided with a concave hook corresponding to the assembly of recoiling sheet in bridge style. The concave hook is pivotally fixed to form a flexible pressing board and it keeps suitable space from the upper wall of the concave hook which forms an angle for the flexible pressing board to have a space to bend and the space for the fabrication of the bridge style of recoiling sheet. The flexible pressing board has its one end projecting to form a pressing block to make depression at the pivotally fixed position corresponding to the fastening hole on the tube seat of the control mechanism which shows its being controoled extends deep into the middle rod to release the act of the shuttle arrow's fastening block. The other end of the flexible, pressing board defines the pressing portion which corresponds to the position of the fastening sheet of the control mechanism. The section divider may act against to make the flexible, pressing board to generate angle inclination forward and the pressing block for deep depression has downward inclination angle to define the section divider. The divider shows cup like body to act movably as a set to cover the control mechanism and the position outside of the tube seat under the fastening sheet in coordination with the action spring provided under it. It corresponds to the top set of the wall face of the set seat within the handle. It is in response to the extension of the middle rod and contraction to make the divider's upper and downward movement. Such act supports against the pressing portion of the flexible, pressing board by deeply pressing of the block's end for position fixation in a downward inclination angle. The block for deep pressing may be pressed into the skeleton rod of the lower section to trigger the shuttle arrow for releasing catching. It may by sequence respond sectionally to fastening sheet for button pressing action or releasing of shuttle arrow's fastening block, opening of the umbrella, the manipulation of the umbrella's surface. The upper nest within the plural section type of umbrella's skeleton mechanism is provided with the portion for placement of rope which is in the shape of round, smooth projecting part or it is equipped with a set of pulley.

Within the middle rod, there provides a variation mechanism which can further be composed of hollow, long seat, the first and second movable rope seat and fixed rope seat in coordination with the middle rod assembly composed of the skeleton rod of more than four sections of skeleton. Of them, the first movable rope seat is just in the upper end of the long seat near the end face of upper nest and it also correspond to one end within the middle rod of the extending first pulling rope. Besides, the seat body of the first movable rope seat is provided with the portion for rope placement for the installation of the the second pulling rope. At same time, the lower end of the first movable rope seat is formed into taper action face and one hole for securing frame in connection with the action of the fastening sheet of the second movable rope seat. The second movable rope seat acts between the first movable rope seat and fixed rope seat. There provides a fastening sheet on the second movable rope seat in a coordination with the recoiling sheet set to make the fastening sheet to push outward usually in corresponding to the long, hollow seat with the installation of the position fixation hole for attachment at definite position. On the reverse side of the fastening sheet, there is a concave portion to correspond to the hole for fastening frame at the first movable rope seat when the fastening sheet is pushed away by the taper's action face of the first rope seat from the position fixation hole, the affixation acts accordingly. In the second movable rope seat, the portion for rope placement is also formed to correspond to the second pulling rope set. The fixed rope seat is also provided and fixed at the lower end of the long hollow seat and it is provided with a set hole. At same time, it is provided with the portion for rope placement similar to that of the first movable rope seat. At the both ends of the first pulling rope, they respectively correspond to the upper end of the first movable rope seat and the action tube connection of the lower nest. One end of the second pulling rope is fixed at the end face of the fixed rope seat. Then the second pulling rope at first by order threads through the portion of the rope placement of the first pulling rope and then wind to pass through the portion for the rope placement of the fixed rope seat. Then if extends upward through the portion for rope placement of the second movable rope. Subsequently it passes through the set hole of the fixed rope seat and then it spreads through the set rope of the fixed rope seat and stretches to connect the shuttle arrow.

The first pulling rope and the second pulling rope of variation ratio mechanism have the total length in extension to be proportional to the length of the extended middle rod and the lower nest's travel to open umbrella in total. The first movable rope seat, the second movable rope seat of the variation ratio mechanism and the portion for rope placement provided at the fixed rope seat are in the shape of round, smooth projection or it provides the pulley assembly in substitution.

The present invention is compared with the existing technology to obtain the advantage over the latter one in that:

The present invention device borrows the logical and arithmetic theory to set up the mechanism for variable ratios which can be proportionally adjustable for changes and is applied to the plural sections of middle rod within. Besides, the movement ratio is corresponding to the length of the middle rod's extension travel. The movement ratio or connection movement yields the proportional adjustment by the release of the dynamic energy to support and open the surface in umbrella when its surface is gradually expanding, improving the traditional dynamic energy which gradually releases to meet the need of the dynamic energy for consumption when the surface in umbrella is developing to full extent and then such energy decreases to smaller extent. It removes the traditional rope control with the restrictive use of the middle rod's number of sections. It is applicable to the number of various kinds of umbrella's skelebase seat in coordination with the channel opened in the flexible space adjascent to the base seat. In the channel there is fastener which is normally pressed by the inside wall of the lower section's skeleton rod on the recoiling sheet of the flexible space. The middle rod extends to open umbrella corresponding to the locating holes opened at the lower section skeleton rod to fasten it in fixed position to withstand wind.

The upper nest within the plural sections of umbrella skeleton mechanism and the portion for rope placement provided by rope block are in the shape of round , smooth protruding portion or it is provided with pulley device.

The present invention is compared with the existing technology to get advantage over the latter in that:

The present invention device borrows the logical and arithmetic theory to set up variable ratios' mechanism, which can be proportionally adjustable for changes and is applied to the plural sections. It has the capability of plural folds which becomes the automatic manipulation in closing umbrella's surface area. It is also provided with locator for the fixation of the position at the extending skeleton rod of the middle rod so that the umbrella shall not move up and down along with the wind in unstable condition in which the wind would cause the contraction of the umbrella's surface area and then it reopen again due to its lack of firmness in wind.

DETAILED DESCRIPTION OF THE PREFERRED EMODIMENT

Figure 1:
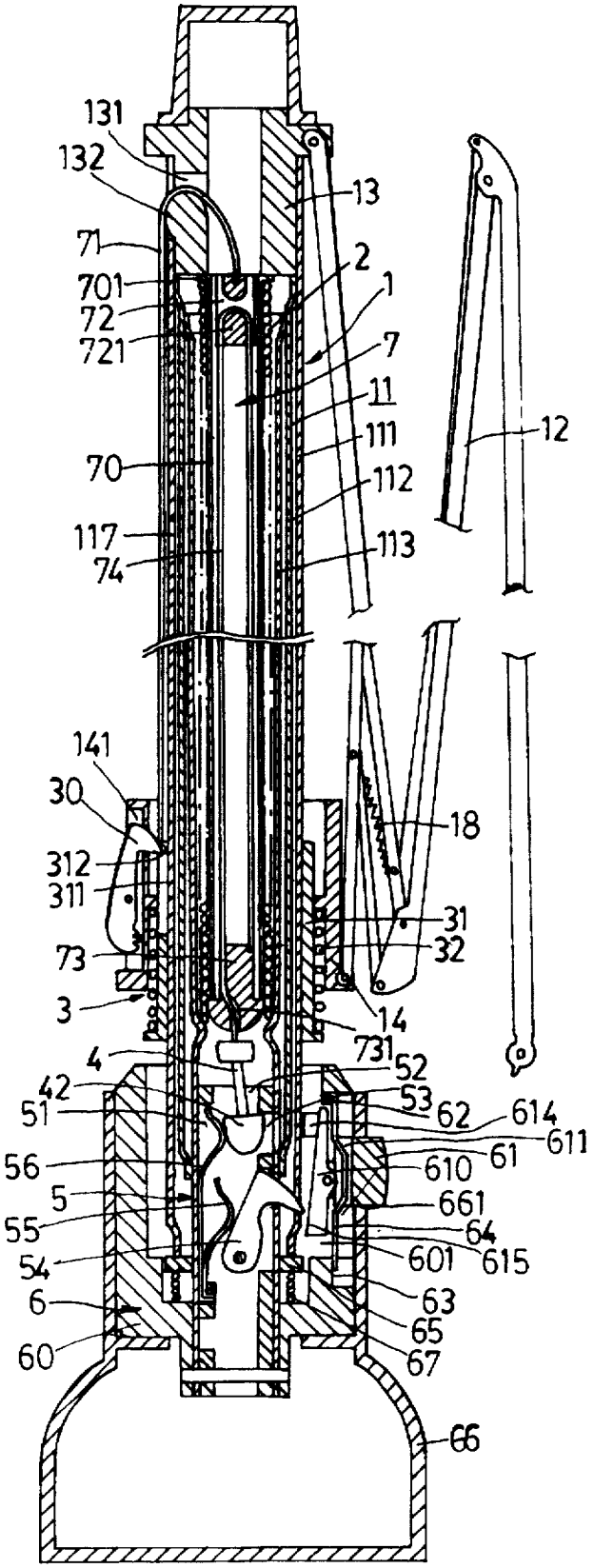
FIG. 1 is a sketch of the new assembly in energy reservation state in cross section.
Figure 2:
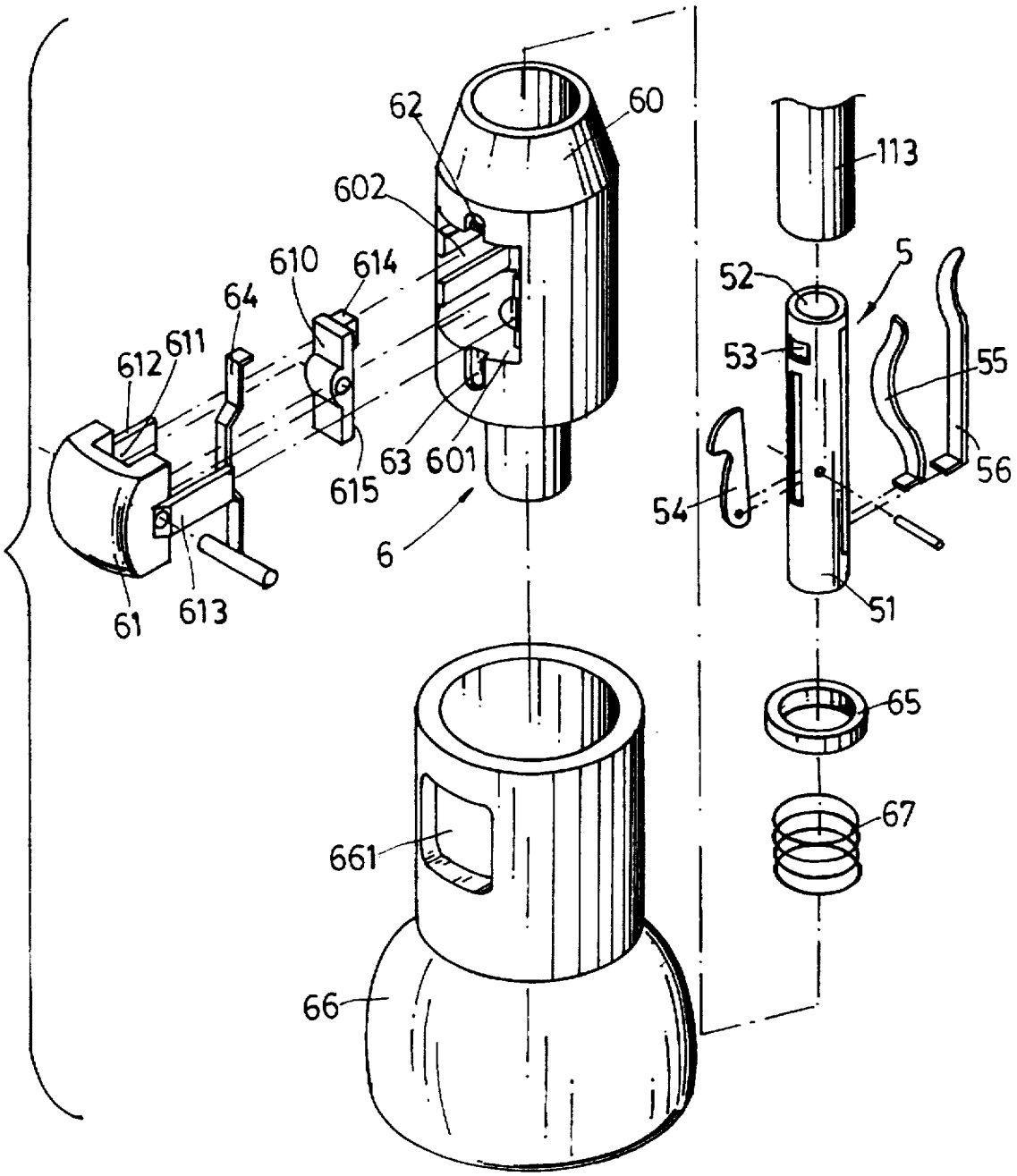
FIG. 2 The mechanism to control and handle in solid state shown in the Drawing for FIG. 1 for diagram.

Referring to FIG.1&2; it is a new, practical umbrella in three foldings to be described in practical example in its structure and the relationship of their interactions with assemblies to be indicated in the cross section drawings and solid diagram. We clearly see the components and parts in its structure including one plural sections of umbrella's skeleton mechanism 1, spring for opening umbrella 2, locator 3, shuttle arrow 4, control mechanism 5, handle 6 and variation and ratios mechanism. The plural section type of umbrella skeleton mechanism 1 is made up of middle rod 11 and certain components, spring for closing umbrella 18 and branch skeletons 12. Of them, the middle rod 11 includes upper, middle and lower sections of skeleton rods 111, 112, 113. They show the condition in which they can be coupled each other. The upper end of the upper section skeleton rod 111 is provided with the upper nest 13. The side wall of upper nest 13 has a hole 131 provided with portion for rope placement 132 under the lower end of the hole 131 to form a round, smooth, protruding portion (as shown in FIG. 1) or it made up of pulley shaft for the use by the first pulling rope 71 to twine around the variation and ratio mechanism 7. The first pulling rope 71 winds around the portion for rope placement 132 It extends to one end outside of the middle rod 11 and connected to the action tube 31 of locator 3 installed at lower nest 14 of the middle rod 11 to draw the lower nest 14 away from its place, to locate and release the closing umbrella in action. The locator 3 includes one fastening sheet 30 made within the containing chamber 141 provided at the lower nest 14. At same time an action tube 31 of the sliding hook 311 is installed between the lower nest 14 and middle rod 11. From the action tube 31, the first pulling rope 71 draws and the space between the protruding shoulder wall 312 at the lower end of action tube 31 and inside the uppernest is installed and supported with a spring 32. When the umbrella opens and expands, the first pulling rope 71 of the variation and ratios mechanism 7 draws the action tube 31 upward and compresses the reserve energy and drives the lower nest 14 to move upward. The umbrella opens for locating at the definite position with the fastening sheet 30 corresponding to the fastening hole 117 opened at the upper section skeleton rod 111. The upper end hook edge of sliding hook 311 of action tube 31 slides and presses to release the fastening sheet from fixation at definite position. The variation and ratio mechanism 7 has a long, hollow seat 70 to coordinate to the locating edge at the upper end to correspond to the middle rod's 11 spring for opening umbrella 2 one end directly supports against base end face of the upper nest 13 for locating at the definite position. Within the long, hollow seat 70, there provide a movable rope seat 72 and a fixed rope seat 73. The movable rope seat 72 in the folding state on the middle rod is located near the base end face of upper nest 13 corresponding to the assembly of the first pulling rope 71 extending to the end of the middle rod 11. The seat body of the mobable rope seat 72 is installed with the formed portion for rope placement 721 (its shape and structure are same as those of portion for rope placement. It may also use the pulley wheel to do so.) There is the second pulling rope 74, and its one end extends along the space inside of the long, hollow seat 70 and then it is fixed at the fixed rope seat 73 at the lower end of the long, hollow seat. The other end of the second pulling rope extends along within the long hollow seat 70 and penetrates the casing hole 731 on the fixed rope seat 73 and finally connects the upper end of the shuttle arrow 4 The two pulling ropes 71, 74 twines around the movable rope seat 72 and the fixed rope seat 73 in proportional lengths to yield the variation and ratio in dynamic travel so as to extend the middle rod 11 and lower nest 14 upward. In other words, the first pulling rope 71 and the second pulling rope 74 have their total length proportional to the length of the extending middle rod 11 when the umbrella opens and expands. Then the shuttle arrow 4 has its one end to correspond to the one end of the second pulling rope 74 . It extends to the one end of handle 6, thus forming a fastening block to correspond to the control mechanism to manage the action of closing umbrella.

With regard to the control mechanism 5 and handle 6 (as shown in FIG. 1, 2), the control mechanism 5 includes a hollow tube seat 51 at the position fixed by pin of inner seat 60 within handle 6 for coordination which is at the inside of the lower section skeleton rod 113. The upper end face and side end face of the tube seat 51 are respectively installed with the passage hole 52 and fastening hole 53 to correspond to the insertion of shuttle arrow's 4 fastening block in coordination with the function of the second recoiling sheet 56 to support against at the fastening hole 53 for fixation in position. At same time, there is a fastening sheet 54 installed within the tube seat 51 for the function of the first recoiling sheet 55 to press and bouncing against and from the middle rod 11 to match the manipulation, check and release of the middle rod 11 or shuttle arrow for the action of opening and closing of the umbrella. The first and second recoiling sheets 55,56 show different lengths to define and superimpose over the rear side of the fastening sheet 54. They respectively correspond to the fastening sheet 54 and shuttle arrow's 4 fastening block 42 for recoiling function. The handle 6 is made up of the inner seat 60 and handle housing 66 and they are coupled each other in one set. It is fixed at the end of the lower section skeleton rod 113. Within the side wall of the inner seat 60 there provides a set of buttoning holes 601 to match the buttoning holes 661 provided at the handle housing 66. And at the buttoning hole 601 of the inner seat 60 and the upper and lower ends, there are two place opposite each other respectively forming tipper and lower sustaining seats 62, 63 to mount a bridge type of recoiling sheet 64 which penetrates and installs itself between the inside of buttoning hole 61 and flexible pressing board 610 to match the buttoning hole 61 in support against the top to render the recoiling function. Once being oppressed, it returns to the original position for next operation or action. The inside of the button 61 is provided with a concave hook 611 to correspond to the bridge type recoiling sheet 64. The button 61 extends and forms one pair of left and right L shape arms 612, 613, showing a pair of guided tracks 602 in the space within the inside of inner seat 60 in movable manner to serve as guidance and limitation of the button 61 in its moving direction . The above said flexible pressing board 610 is pivotally fixed within concave hook 611 of button 61 it has a proper distance from the upper wall of the concave hook 611, and it serves as a space for flexible pressing board to have the room for bending in angle and also the area for the assembly of the bridge type recoiling sheet 64. The bridge type recoiling sheet 64 has a horizontal rack which is used to guide the flexible pressing board 610 to be in correction position in horizontal level. The front end of the flexible pressing board 610 is projecting in shape having a deep pressing block 614 which matches the position of the fastening hole 53 of the tube seat 51 at the control mechanism 5. It can be controlled and it penetrates the middle rod for release release of the fastening sheet 54 of the control mechanism 5. It may also by means of the sectional divider 65, it supports to make flexible pressing board 610 to yield forward inclination angle and the downward inclination angle of the deep pressing block 614 to provide the section to trigger the action of the fastening sheet 54 and shuttle arrow 4 to conduct the opening and closing of umbrella. The divider 65 is make in shape of a cup body to be coupled movably with the control mechanism 5 and outside of the tube seat 51 at the lower side of the fastening sheet 54. The action spring 67 is provided at its lower side to correspond to the wall face of the inner seat 60 at the handle 6. The spring corresponds to the contraction of the middle 11 and the supporting against the top of the lower end of the pressing portion 615 of the buttoning 111 to compress the action spring 67 to conserve energy. The section divider 65 is pressed to retract away from the pressing portion 615 of button 61 to support and correspond. When the umbrella opens and developes with the upper section skeleton rod 111 of the middle 11 extends and retracts away, the sectional divider 65 is pushed to the underside of the fastening sheet 54 to correspond to the lower end's pressing portion 615 of the the flexible pressing board 610 of the button 61 in supporting and that yields the front inclination angle in change to serve the pressing button 61 to press to make the deep pressing block 614 to make deep penetration into the fastening hole 53 of the lower section skeleton rod 113 and correspond to the fastening block 42 of shuttle arrow to release the check and to close the umbrella. The action fastening sheet 54 of the pressing portion 615 of the button 61 releases the sectional action's control in opening umbrella.

Figure 3:
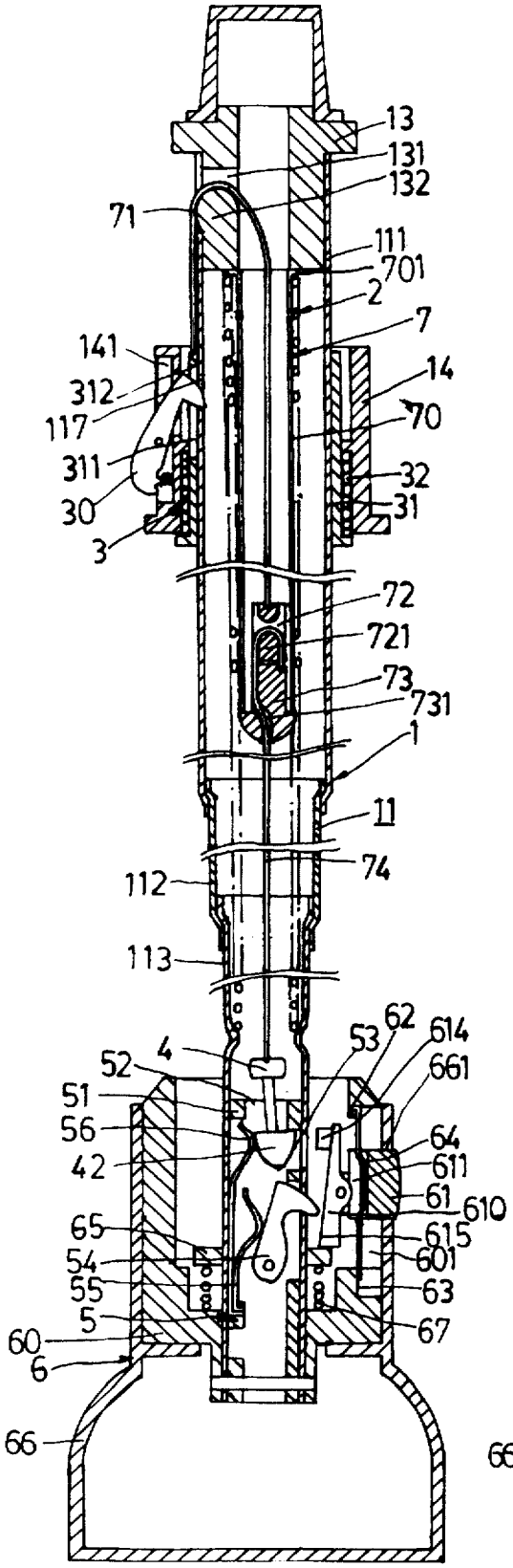
FIG. 3 It is the umbrella's expanding state as shown in FIG. 1 for the sketch of action in cross section.

The above said parts are assembled as FIG. 1 shows. The surface of umbrella's normal closing and opening and the complete contraction of the middle rod 11 as well as the fixation of the position by the fastening sheet 54 are all shown. The spring for opening umbrella 2 is in contraction state to conserve energy. The fastening block 42 of shuttle arrow matches the insertion into the control mechanism's 5 tube seat 51 when the middle rod 11 contracts. The second recoiling sheet 56 presses to make the fastening block 42 to make reverse fastening at the fastening hole 53 of tube seat 51. At same time, the divider 65 presses the top of end edge of the upper section skeleton rod 111 when the middle rod contracts and fixes at definite position and it moves downward and presses the spring 67 to conserve energy to make the flexible pressing board 610 of button 61 not to yield change in the forward inclination angle and to make the bridge type recoiling sheet 64 to preserve the flexible pressing board 610 to show in horizontal level and to make the flexible pressing bord's 610 pressing portion 615 to correspond to the pressing and controlling function of the fastening sheet 54. The variation and ratio mechanism's 7 movable rope seat 72 and fixed rope seat 73 also show respectively the long, hollow seat's 70 lower end and the movement position at the upper end of the long, hollow seat 70 as shown in FIG. 1. When the user manipulates to open umbrella, he shall presses button 61 by pressing handle 6. At that time, the flexible pressing board 610 to cause the bridge type recoiling sheet 64 to function downward in the horizontal state. Under the restrictive dynamic travel of the bridge type recoiling sheet for the deep pressing block 614, the for the deep pressing block 614, the block can not extend into the fastening hole 53 of the control mechanism 5 to avoid mistaken activation. The flexible pressing board's 610 lower side end's pressing portion 615 matches and presses against the fastening sheet 64 to release the check of the upper section rod 111 at the middle rod 11. When the user releases the pressing and the bridge type recoiling sheet 64 shall cause the button 61 and flexible pressing board 610 to return to normal and original state. When the middle rod 11 and the upper section skeleton rod 111 are free from the check, the spring for opening umbrella 2 conserves energy and functions to push forward the extension and travel act of the middle rod 11. When the middle rod 11 extends, the variation and ratio mechanism 7 is fixed at the position of the upper section skeleton rod 111. During the dynamic travel of the middle rod 11 in its extension, the one end of the pulling rope 74 in the variation and ratios mechanism 7 is checked and fixed at the definite position by shuttle arrow. In relation to the dynamic travel in the extension of the middle rod 11, the movable rope seat 72 is led to move toward the fixed rope seat 73 and downward along with the movement of the movable rope seat 72. AT same time, the first pulling rope 71 draws the lower nest 14 an locator 3 so that the action tube 31 of the locator 3 is pulled to compress the spring 32 for conservation of energy and to drive the lower nest 14 to move upward so as to open and expand the umbrella's surface. When the umbrella opens and reaches the definite position, the fastener sheet 30 of the locator 3 is moving toward the of the locator 3 is moving toward the middle rod 11 and in pressing action due to the function of spring force. The fastener sheet penetrates the containing chamber 141 of the lower nest 14 and the slide hook 311 of the action tube 31 to match and respond to the fastening hole 117 provided on the upper section skeleton rod 111 to check and fix the lower nest 14 so as to yield the function to withstand wind and the umbrella's surface shall not be affected by the wind force and no local contraction and then expansion again on the part of umbrella will thus be formed. In the present new invention, after the umbrella's surface is controlled to open as shown in FIG. 3, and the locator 3 fixes the position on it when the umbrella opens to withstand wind. The lower and middle sections of the skeleton rod 112, 113 continue to show the flexible but non-locating manner to constitute the protection of one umbrella skeleton mechanism 1. That means when the umbrella's surface opens and it receives great wind force, the surface shall not make contraction due to the function of the locator 3. Then such a situation may cause the bending and distortion of the umbrella's skeleton mechanism 1 to the extent of damage. But due to the non-locating function of the middle and lower sections of skeleton rods, the middle, lower sections of skeleton rod 112, 113 shall nevertheless yields the displacement due to displacement. During such displacement, the stress and tension upon the middle rod 11 and variation and ratios mechanism 7 shall be lessened. Relatively the spring 32 in the locator 3 yields the corresponding energy in conservation which can be released, and the action tube 31 moves downward. If the middle and lower sections of skeleton rods 112, 113 contract due to wind force to set the dynamic travel and the sliding hook 311 of the action tube 31 have the hook's edge on the upper end of sliding hook 311 to be able to act and release the fastening sheet 30, then the umbrella surface shall automatically yields its closing to avoid damage to the umbrella's skeleton mechanism 1.

Figure 4:
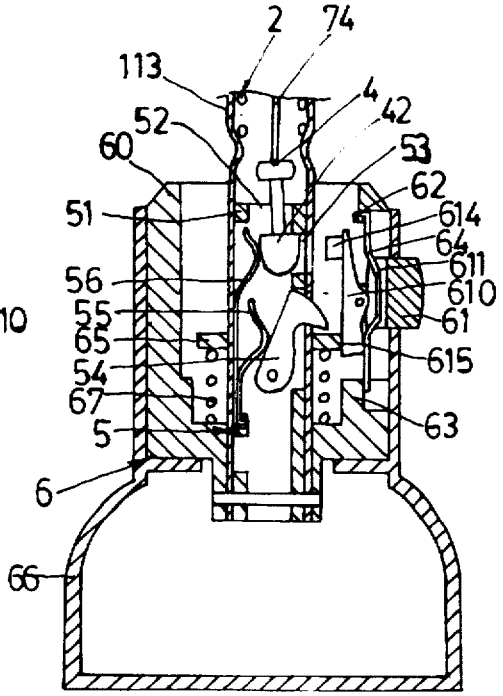
FIG. 4 It is action of handle's section in sketch after the manipulation of the umbrella.
Figure 5:
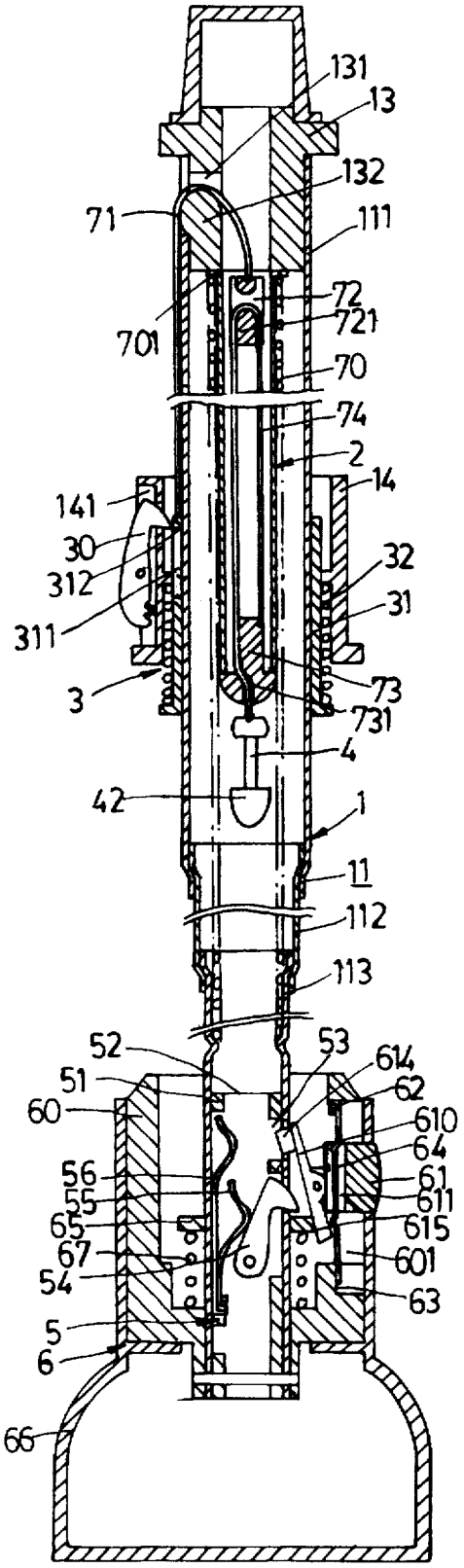
FIG. 5 It is sketch in cross section of the action in closing the umbrella in cross section.

When the operation of opening umbrella is conducted with the extension of the middle rod 11, the release of the check and oppression on the divider 65 is made by the upper section skeleton rod 111 in relatively manner. The divider 65 is driven upward by spring's 67 bouncing action to respond to the upper limit to hold the position and to match the lower position of the pressing portion 615 of the flexible pressing board 610 in supporting action to generate the change in the forward inclination angle of the flexible pressing board 610. The forward inclination angle changes the fixation in position to make the deep pressing block 614 to move downward to the position in relation to the angle. So when the button 61 is pressed again, it is able to drive the shuttle arrow 4 (as shown in FIG. 4 ) in the fastening hole 53 of the control mechanism 5 into which the shuttle arrow 4 extends deeply. When the user closes the umbrella in manipulation and again presses the button 61, it makes the deep press block 614 of the flexible pressing board 610 is directly pressed to move and penetrate the fastening hole 53 provided at the tube seat of the control mechanism 5 to straightway press and push the fastening block 42 of the shuttle arrow 4 toward and into the middle rod 11 (as shown in FIG. 5). At same time, the first pulling rope of the variation and ratios mechanism 7 shall not receive the drawing action force again and do not act on the lower nest 14 and locator 3 . The spring 32 of the locator 3 has been released by the functional force of the conservation force of the first pulling rope 71 in drawing and traction. Correspondingly the spring's dynamic energy conserved is released to cause the action tube 31 to move downward. When the action tube 31 moves to certain extent, the tipper end edge of the sliding hook 311 follows its continual downward movement to push the fastener sheet 30 out to release the check and fixation in position by the fastener sheet 30 to the middle rod 11 and the fastening hole 117 of the upper section of skeleton rod as shown in FIG. 5. Then in coordination with the function of the branch skeleton of umbrella and spring for closing it, and the contraction of the upper section rod 11 toward the middle section skeleton rod 112, it follows the closing of the umbrella's surface and the lower nest 14 to move downward. It draws the variation and ratios mechanism 7 and shuttle arrow 4 to move back to the manner as shown in FIG. 1, until the user again contracts the middle rod It and conserves energy to fasten and check for shuttle arrow 4 to be used in the next time. The sectional divider 65 is also pressed by the upper section skeleton rod to support the flexible pressing board 610 which went downward for leaving at the pressing portion 615. In coordination with the function of the bridge type recoiling sheet, the flexible pressing board 610 is caused to show the normal horizontal level again for the next operation.

Figure 6:
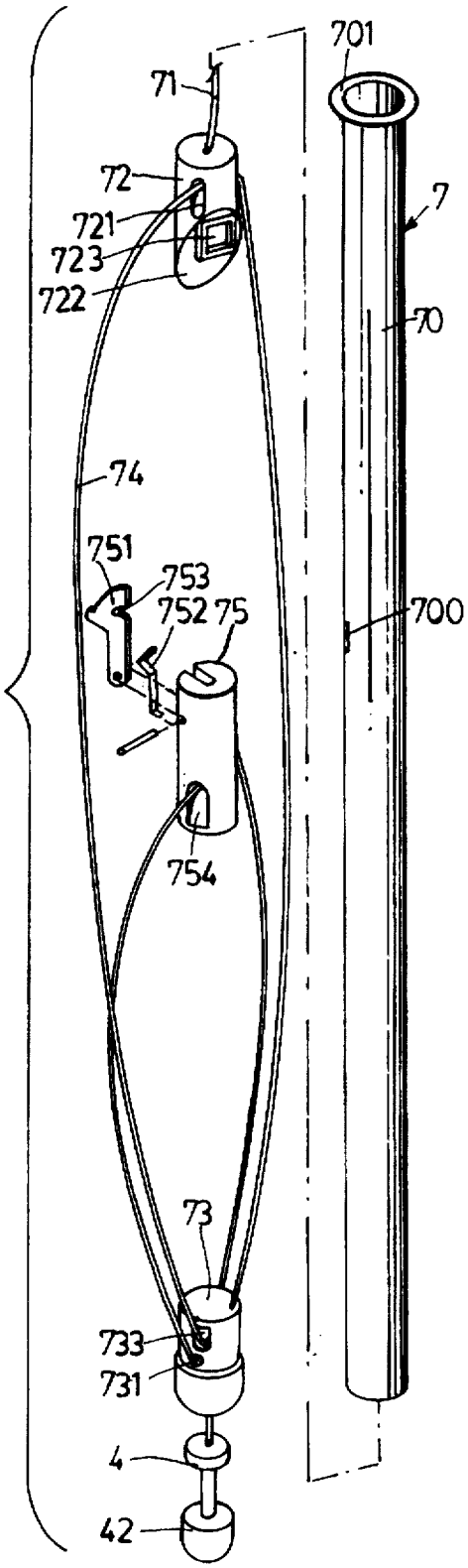
FIG. 6 It is new, practical variation and ratio mechanism in cross section as a sketch. It is another practical example about the sketch on solid structure.
Figure 9:
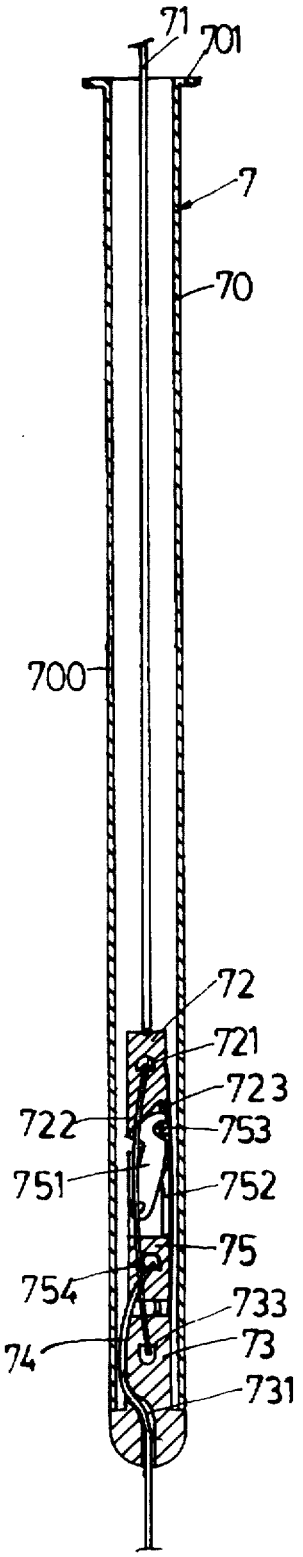
FIG. 9 It is the practical example on the opening umbrella's state in cross section as shown in FIG. 6.
Figure 8:
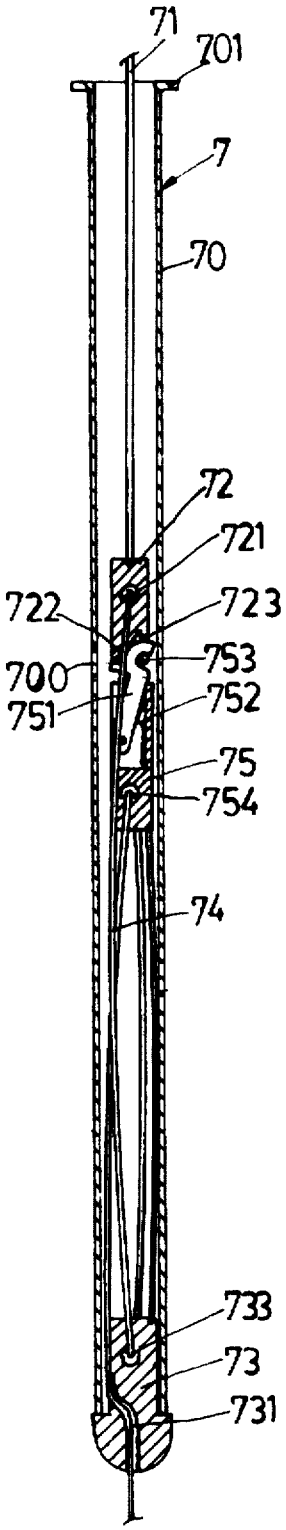
FIG. 8 As shown in FIG. 6, it is a practical example on the dynamic travel in opening umbrella and moving the rope seat in connection condition as a sketch.
Figure 7:
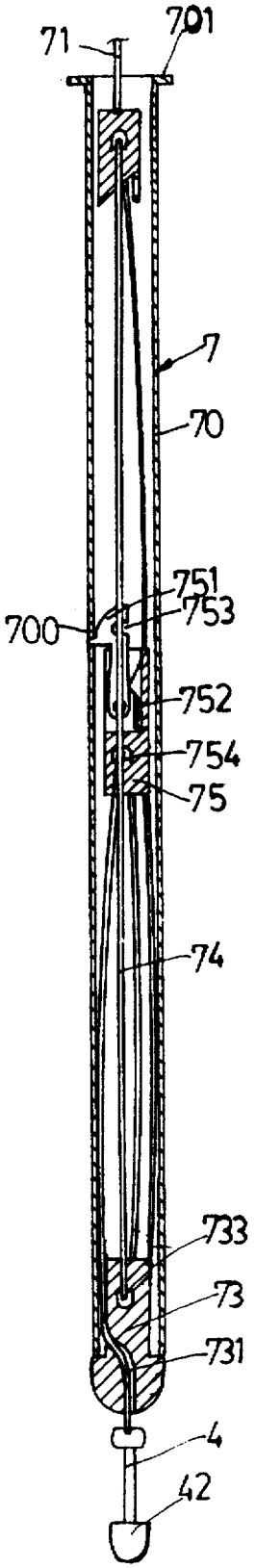
FIG. 7 It is a sketch of the practical example's assembly in cross section as an idea sketch as shown in FIG. 6.

FIGS. 6 & 7 show another practical example for the practical and new variation and ratios mechanism. It is applicable to the four foldings of umbrella (and having four sections of skeleton rods in composition). The above illustrations depict the invention's practical structure and the action manner. From those drawings, we may clearly see the variation and ratios mechanism 7 in the practical example also has a long, hollow seat 70 which, in coordination with the locating edge 701 at the upper end corresponds to the spring for opening umbrella 2 within the middle rod 11. One end directly supports the end face of the upper nest 13. The two movable rope seats 72, 75 installed within the long hollow seats and fixed rope seat 73 is also installed inside of the long , hollow seat. During the state of the middle rod's folding, the first movable rope seat 72 is just located near the end face in the bottom of the upper nest and it matches with one end within the middle rod of the first pulling rope which extends into it. The first movable rope seat 72 has its body installed and formed with portion of rope placement 721 ( its shape and structure are same as those of the upper nest's rope placement portion or it may also he used by the pulley wheels ) which is used for the installation of the second pulling rope 74. At same time, the lower end face of the first movable rope seat 72 is formed into tapered action face 722 and the hole for fastening frame 723 in order to correspond the fastening sheet 751 of the second movable rope seat 75. The second movable rope seat 75 activates between the first movable rope seat 72 and the fixed rope seat 73. The second movable rope seat 75 matches with the recoiling sheet 752 to have the provision of a fastening sheet 751 which is enabled to push out to correspond to the location hole 700 provided at the long, hollow seat 70 for checking and fastening at the definite position. The reverse side of the fastening sheet 751 is provided with a concave portion 753 which can match the hole for fastening frame 723 at the first movable rope seat 72 for connection. Also the second movable rope seat 75 is formed to have the rope placement portion which is similar to the rope seat portion's 754 at the first movable rope seat 72 to correspond to the windings of the second pulling rope 74. Also the fixed rope seat 73 is also fixed and installed at the lower end of the long, hollow seat 70 and it is also equipped with casing hole 731. At same time, there installs a movable rope seat similar to the rope placement portion 733 at the first movable rope seat 72. Both ends of the said first pulling rope correspond respectively to the upper end of the first movable rope seat and the action tube 31 of the locator 3 at the lower nest 14, while one end of the second pulling rope 74 is fixed at the end face of the fixed rope seat 73. By order the second pulling rope twines and passes through the rope placement portion 721 of the first movable rope seat 72 and then threads through the rope placement portion 733 of the fixed rope seat 73. Again it extends upward to pass through the rope placement portion 754 of the second movable rope seat 75. Subsequently it again passes through casing hole 731 of the fixed rope seat 73 and extends downward to connect the shuttle arrow 4 (as shown in FIG. 6). After the two pulling ropes 71, 74, and the first and second movable seats 72, 75 and fixed rope seat 73 are assembled, the second pulling rope is located between the first and second movable ropes 72, 75 to show the state of the two lines. The second pulling rope 74 which is between the second movable rope seat 75 and the fixed rope seat 73 shows the condition in the four sections of rope and in dynamic process and ratios. Besides, the total length of the two pulling ropes 71, 74 in extension also match with movement travel of the lower nest 14 and the extension of the middle rod 11. The second rope seat 75 is installed between the first movable rope seat 72 and fixed rope seat 73 to set or adjust the length of the second pulling rope 74 and its action and movement travel to correspond to the setting of proportional movement travel of various sections of the middle rod. At same time, the variation and ratios mechanism 7 has two section continuous action's variation movement travel and actions. When the user opens umbrella for for operation and releases dynamic energy in opening it , the variation and ratios mechanism 7, and one end of the second pulling rope 74 are checked by the shuttle arrow 4. Under the mutual drawing and pulling of the second pulling rope 74 and relative actions and movement travel, the first movable rope seat 72 is caused to move downward while the second movable rope seat 75 is checked and held by the fastening sheet 751 at the long, hollow seat's 70 locating hole 700. They do not move simultaneously. When the first movable rope seat 72 moves to the location of the second movable rope seat 75, the fastening sheet 751 shall be moved by the first movable rope seat 72 and tapered action face 722 in push and control to disengage from the. affixation. The concave portion 753 of the fastening sheet 751 corresponds to the hole for fastening frame 723 of the first movable seat 72 for check and connection as shown in FIG. 8. and to release the synchronous downward movement of the second movable rope seat 75 and the first movable rope seat 72. When it moves to the fixed rope seat's 73 upper position, the operation in opening umbrella is finished ( as shown in FIG. 9). At the eary stage of opening umbrella, the variation and ratios mechanism 7 has the coordination of the first movable rope seat and the two sections' second pulling rope 74 through which the rope threads to make the spring for opening umbrella 2 to release the dynamic energy with less energy to apply ( because at early stage of opening umbrella, the energy to operate is less.) Then the first and second movable rope seats are connected for action; it forms to act with fixed rope seat 73 and the second pulling rope 74 in winding in conjunction with the dynamic energy of the pring for opening umbrella 2 which requires more energy to take actions in order to correspond to make full expansion of the umbrella's cloth surface at last stage which requires greater energy to meet the demand.

We claim:

1. An automatically opening and closing umbrella including a skeleton system, springs, a control mechanism, a mechanism to make changes, a locating device, and a handle, and comprising:

a) multiple sections of the skeleton mechanism, comprising a middle rod, a first spring for closing the umbrella and a branch skeleton which includes upper, middle and lower sections telescopically inter connected, an upper nest located on an upper section of the middle rod, the upper nest having a hole and a rope portion below the holes a first pulling rope extending outside of the middle rod and connected with the locating device and the upper section's skeleton rod having a fastening hole;

b) a second spring for opening the umbrella is placed within the middle rod having a first end connected to a locating edge on a mechanism to make changes at a long hollow seat's upper end, and a second end connected to a lower end face of a protruding point formed on the middle rod;

c) the locating device including a first fastening sheet assembled within a container chamber of a lower nest, and action tube having a protruding shoulder wall at a lower end and a third spring between an inner side of the lower nest and the action tube;

d) the mechanism to make changes includes a long hollow seat cooperating with the second spring for opening the umbrella within the middle rod a first end directly bearing against a bottom face of the upper nest, within the long hollow seat are located a movable rope seat and a fixed rope seat, the movable rope seat and the first pulling rope extend to one end of an inner side of the middle rod, a second pulling rope having a first end connected to the fixed rope seat at a lower end of the long hollow seat while and a second end passes through a casing hole in the fixed rope seat and is connected with a shuttle arrow placed within the lower skeleton rod and extending toward one end of the handle, the shuttle arrow having a fastening block;

e) the control mechanism including a hollow cylinder seat within the lower section rod, the cylinder seat having an opening hole and fastening hole located to engage the fastening block of the shuttle arrow, a second fastening sheet within the cylinder seat which presses against the middle rod together with a first recoiling sheet for recoiling and fixation in response to a pressing button of the handle, the first and a second recoiling sheets, have different lengths and are placed one over the other in a rear side of the fastening block; and f) the handle is provided at an end of the lower section rod and includes an inner set seat on which there is a button hole and two positions opposite to each other at an edge of a lower side are located upper and lower sustaining seats, for mounting a bridge type of recoiling sheet which threads through and is installed between an inner side of a pressing button, and a pivotal flexible pressing board, the flexible pressing board has one end installed with a projecting pressed block and another end is equipped with a pressing portion corresponding to the second fastening sheet of the control mechanism, a wall of cylinder seat of the control mechanism at its outside under lower side of the second fastening sheet and a fourth spring under the cut body shape.

2. The automatically opening and closing umbrella of claim 1, wherein the rope portion in the upper nest of the umbrella's skeleton mechanism comprises a round and smooth projection portion.

3. The automatically opening and closing umbrella of claim 1, wherein the middle rod further comprises a variable mechanism having first and second movable rope seats, and a fixed rope seat, the first movable rope seat located at an upper end of a long seat when the middle rod is in closed and folded a seat body of the first movable rope seat is connected with a second pulling rope, the first moving rope seat having a lower end face formed with a tapered action face and a hole for connecting with a fastening frame of a fastening sheet and the second movable rope seat, the second movable rope seat located in a space between the first moving rope seat and the fixed rope seat, the second moving rope seat having a fastening sheet cooperating with the recoiling sheet, a side edge face of the fastening sheet being provided with a concave portion corresponding to the hole in the first movable rope seat, the fixed rope seat being fixed at a lower end of the long, hollow seat both ends of the first pulling rope are respectively connected to an upper end of the first movable rope seat and to an action tube, one end of the second pulling rope is fixed at an end face of the fixed rope seat, the second pulling rope being connect to the shuttle arrow.

4. The automatically opening and closing umbrella of claim 1 further comprising a variable mechanism having a first pulling rope and a second pulling rope extendable to its total length to move the dynamic travel to open the umbrella.

5. The automatically opening and closing umbrella of claim 1 further comprising a variable ratio mechanism having a first movable rope seat, a second movable rope seat provided with portions for rope placement, and a fixed rope seat having a round, projection portion.

* * * * *